US005633670A

United States Patent [19]

Kwak

[11] Patent Number: 5,633,670

[45] Date of Patent: May 27, 1997

[54] THERMAL PRINTING APPARATUS AND METHOD THEREOF

[75] Inventor: Hee-gook Kwak, Suwon, Rep. of Korea

[73] Assignee: Samsung Electronics Co., Ltd., Kyungki-do, Rep. of Korea

[21] Appl. No.: 235,519

[22] Filed: Apr. 29, 1994

[30] Foreign Application Priority Data

Apr. 29, 1993 [KR] Rep. of Korea ..... 93-7299

[51] Int. Cl.[6] ..... B41J 2/36; B41J 2/365

[52] U.S. Cl. ..... 347/188; 347/193

[58] Field of Search ..... 347/193, 175, 347/198, 214, 171, 172, 184; 400/120, 708, 207, 120.01

[56] References Cited

U.S. PATENT DOCUMENTS

| | | | |
|---|---|---|---|
| 4,795,999 | 1/1989 | Takahashi et al. | 347/193 |
| 4,890,120 | 12/1989 | Sasaki et al. | 347/175 |
| 4,897,670 | 1/1990 | Hasegawa et al. | 347/193 |
| 5,220,352 | 6/1993 | Yamamoto et al. | 347/172 |

*Primary Examiner*—Benjamin R. Fuller
*Assistant Examiner*—L. Anderson
*Attorney, Agent, or Firm*—Sughrue, Mion, Zinn, Macpeak & Seas

[57] ABSTRACT

A thermal printer prints on a printing medium by heating a thermal print head which causes sublimation of a printing film at the areas corresponding to data or image to be printed. The sublimated dye on the printing film results in the data or image being printed on a supplied print medium. The types of print medium and printing film are sensed and the heating energy supplied to the print head is controlled in accordance with the types of medium and printing film used. The heat is controlled by varying the level of voltage supplied thereto, or by varying the duration of voltage supplied thereto, or by varying the repetitions of the printing operation, or by combinations of the latter. The type of medium used is sensed by sensing the light transmissivity or reflectivity of the medium. The type of printing film used is sensed by either sensing a bar code on the cartridge housing the film or by sensing a uniqueness of the shape of the cartridge housing the printing film. A micro-computer determines whether or not the sensed medium and film are suitable for a predetermined printing mode and, if the state is suitable, controls the performance of a printing operation according to a predetermined printing mode, and if the state is not suitable, displays the sensed information, to thereby inform the user and request the user to make a decision whether or not the printing is to proceed. When a print proceeding signal is input, the heating energy of a thermal print head is controlled so as to fit the predetermined mode.

22 Claims, 9 Drawing Sheets

THERMAL PRINTING APPARATUS AND METHOD THEREOF

BACKGROUND OF THE INVENTION

The present invention relates to a thermal printing apparatus, and more particularly, to a thermal printing apparatus which controls the thermal energy of a thermal print head (TPH) depending on the kind of printing paper and film employed in a sublimation type thermal printer.

In general, a sublimation type printer, which performs printing by employing a TPH, prints a desired image or picture on a print medium, such as paper, by sublimating the dyes deposited on a film, using the thermal energy emitted by the TPH to which a current is applied.

As shown in FIG. 1, in the above-described common thermal printing apparatus, an analog image signal delivered from signal input sources, for example, a video camera or television, is input as red (R), green (G) and blue (B) signals and converted into a digital signal form in an A/D converter 10.

A first selector 20 selects a signal output from A/D converter 10 or a digital image signal delivered via protocols such as GP-IB, SCSI and CENTRONICS from a digital signal input source, for example, a personal computer or graphics computer.

The signal selected by first selector 20 is stored in a memory 30 in frame units or field units under the control of a memory controller 40, which controls time for writing-in and reading-out of data.

In a second selector 50 constituted by a multiplexer, R,G and B data stored in memory 30 are selectively read-out and provided to a color converter 60. Each of the R, B, and G signals selected by second selector 50 is converted into a complementary color signal. That is, the B signal is converted into a yellow (Y) signal, the G signal is converted into a magenta (M) signal and the R signal is converted into a cyan (C) signal in color converter 60.

In corrector 70, various corrections, for example, gamma, color, resistance and temperature corrections are performed on the output of color converter 60 and the result is written into a line memory 80 in line units.

Gradations of the data read from line memory 80 in line units are compared with a predetermined gradation value in a middle gradation converter 90. Then, a Strobe signal, which indicates a heating time period in the units of the compared gradation value, is generated, and a TPH 100 is heated for the heating time, to thereby perform a color printing operation. Thus color printing is out by printing each of Y,M and C colors on a single piece of recording paper.

This can be explained as follows. When data is read from memory 30, data of a single vertical line is read out by second selector 50 with respect to an initial B signal and converted into a Y signal via color converter 60 and written into line memory 80. A middle gradation conversion is performed upon the data written into line memory 80 in middle gradation converter 90, and the converted data is delivered to TPH 100 to complete one line printing. In a video printer which performs printing on A6 sized printing paper (hereinafter, the printer will be called an A6 thermal printer), printing the Y color, i.e., the complementary color of B color, is completed when approximately 500 to 600 lines are printed for a single screen.

Then, in second selector 50, data corresponding to the amount of one screen is applied to line memory 80 in units of one vertical line with respect to the G signal. Thus, printing the M color, i.e., the complementary color of G color, is completed through the above mentioned procedure. Then, the R signal for a single screen is selected by second selector 50 and the R signal for a single vertical line is read out from line memory 80. Thus, printing the C color, i.e., the complementary color of R color, is completed through the above-mentioned procedure.

The A/D converter 10, 1st selector 20, memory 30 and memory controller 40 constitute an image signal processing circuit 1. The second selector 50, color converter 60, corrector 70, line memory 80, middle gradation converter 90, and TPH 100 constitutes a print control circuit 2. An image display circuit which enables an output of image signal processing circuit 1 to be displayed onto a display device, such as a video monitor, may be provided as part of the present invention. In addition, a system controller, not shown in the drawings, for controlling the entire system can be added.

FIG. 2 is a block diagram of the middle gradation converter 90 and the TPH 100 shown in FIG. 1.

Referring to FIG. 2, an address generator 91 generates a write address and a read address for line memory 80. The write address is provided to line memory 80 so that the data corresponding to a single vertical line can be written into line memory 80. When an end address of the write address is generated, an end pulse is generated by address generator 91, thereby enabling a gradation counter 92. The gradation counter 92 operates when data is read out from line memory 80 by the read address generated by address generator 91. Thus, when the data corresponding to a single vertical line has been written into line memory 80, the gradation counter 92 is enabled and a read address is output simultaneously by the address generator 91 in order to make line memory 80 perform a reading operation.

In gradation counter 92, data for gradation level 1 in the form "0000 0001" is output to an erasable programmed ROM (EPROM) 93 and a gradation comparator 96. In gradation comparator 96, a "high" signal is output when the gradation level of the printing data output from line memory 80 is higher than a gradation level output from gradation counter 92, while a "low" signal is output when the gradation level of the printing data output from line memory 80 is lower than a gradation level output from gradation counter 92. The comparison result is delivered in turn to a shift register 101. For example, in an A6 thermal printer, approximately 512 printing data are shifted to shift register 101 and stored therein. This example is for the case of A6 sized paper where the number of heating elements of TPH 100 for printing one line is 512.

If the gradation comparing signal is "high", gradation level 1 can be printed as follows.

Here, if the optical density of gradation level 1 corresponding to the data "0000 0001", is assumed as 0.2, procedures for printing with an energy E1 onto a print film as shown in FIG. 3 are as follows. As shown in FIG. 4, a strobe signal relevant to a time period t1 which corresponds to energy E1 is generated in time width generator 95 and applied to a latch register 102. Then, a heating element 103 is heated for the duration of time t1 which corresponds to energy E1 so as to express gradation level 1.

To perform a heating for gradation level 2, gradation counter 92 outputs the data "0000 0010". Then, in gradation comparator 96, the data read from line memory 80 and the output data of gradation counter 92 are compared and the above-described operation is repeated.

Here, the heating time corresponding to gradation data generated by gradation counter 92 is preprogrammed in EPROM 93. Then, an electronic switch 94 is operated according to an output of EPROM 93 and a Strobe signal is generated in time width generator 95 in units of each gradation level so as to be output to latch register 102.

When the output of shift register 101 is latched to latch register 102, the latched output heats the TPH 103 for a duration t2 corresponding to the width of the pulse generated in time width generator 95.

Thus, when 256 gradations finish heating according to the above-described procedures, which means the completion of one line printing and 500–600 line heatings for one screen in an A6 thermal printer is also completed. Y, M and C color heating is performed in the same manner as the above, to thereby perform a color printing.

In this case, a plot of heating energy with respect to an optical density of each gradation is shaped as an S-curve, that is, heating energy is proportional to the optical density as shown in FIG. 3. The optical density increases as the heating time is lengthened as shown in FIG. 4.

In FIG. 3, curve (1) shows the sensitivity of a plain printing paper while curve (2) shows the sensitivity of an overhead projector (OHP) transparent film, both of which are known print medium for a thermal printer. Since each type of print media has different print sensitivity, the printing method can be varied depending on the printing media.

Both plain paper and OHP film can be used in a conventional thermal printer. The heating value of each heating element within the TPH should be lowered when a picture is to be printed on OHP film than in the case where a picture is printed on plain paper. OHP film has a lower thermal conductivity and a higher surface smoothness as compared with plain paper. That is, since plain printing paper has a better sensitivity than OHP film, OHP film print density is remarkably reduced when printing is performed under the same conditions as for plain paper.

Conventional techniques for solving the above problems are shown in FIG. 5 to FIG. 7.

FIG. 5 is a schematic block diagram showing a thermal printer where the supply voltage for the TPH is controlled. The device shown in FIG. 5 comprises a key controller 110 for setting printing mode, a general purpose computer 120, i.e., an input signal source for providing a picture to be printed, and a first sensor 150 for sensing the kind of printing media supplied to a paper supply mechanism (not shown) of the thermal printer.

A micro-computer 130 is connected to the output terminals of key controller 110, general purpose computer 120 and first sensor 150 in order to control the printing operation according to a predetermined printing mode. The micro-computer can be a system controller. A power supply 140 is connected to an output terminal of micro-computer 130 to provide operating power for TPH 100. The TPH 100, as in FIG. 2, includes a shift register, latch register and heating resistances to sublimate the ink deposited on a sublimation film, is connected to an output terminal of power supply 140.

The device shown in FIG. 5 operates as follows to print on an OHP film. A command for printing on an OHP film is input to micro-computer 130 from key controller 110 or from general purpose computer 120. When OHP film is inserted in the supply mechanism, such as a supply tray, the first sensor 150 recognizes the OHP film by sensing the different reflection or transmission rates of light for plain paper and OHP film. The sensor 150 informs the micro-computer 130 of the insertion of the OHP film. In micro-computer 130, a control signal is generated and supplied to the power supply 140 to cause the power supply 140 to supply to the TPH 100 a voltage that is increased for the OHP film printing mode as compared to that supplied for a normal printing mode where plain paper is used.

In power supply 140, the output voltage varies according to the control signal supplied from micro-computer 130. In TPH 100, the heating energy varies in response to the output voltage supplied from power supply 140. That is, if the printing media is OHP film rather than plain paper, more heating energy is provided for printing.

In general, the heating energy (E) can be expressed as follows.

$$E=(V^2/R)\times t \quad (1)$$

where (V) is the voltage applied to TPH, (R) is the resistance of the heating element, and (t) is the heating time. As shown in expression (1), heating energy (E) is proportional to voltage (V). Thus, the fact that the print density and the image quality of OHP is lower than that for plain paper can be taken into account by controlling the voltage in accordance with the printing media being used.

FIG. 6 is a schematic block diagram showing a thermal printer which controls TPH heating time to compensate for the differences in printing modes. Components of the printer of FIG. 6 which are the same as those of FIG. 5 are denoted by the same reference numerals, and explanation thereof will be omitted.

An middle gradation controller 90, as in FIG. 2, includes an EPROM 93 wherein heating time by gradation units in a normal printing mode and in an OHP printing mode is programmed, is connected to an output terminal of micro-computer 130. In addition, TPH 100 is connected to an output terminal of middle gradation controller 90.

The device shown in FIG. 6 operates as follows. A user selects an OHP printing mode through key controller 110 or computer 120 and the mode selection is recognized by micro-computer 130. When a sheet of print media is inserted into the print media supply tray, the first sensor 150 senses if the inserted media is plain paper or OHP film. If the sheet is OHP film, micro-computer 130 recognizes that the OHP printing mode for printing a picture on the OHP film is the correct printing mode. Micro-computer 130 generates a control signal which is supplied to a higher address port of EPROM 93. The EPROM 93 outputs heating time data in accordance with the control signal input to the higher address port. Here, heating time data for a plain paper printing mode and heating time data for an OHP film printing mode are programmed in EPROM 93. For example, in the case of expressing the same gradations, if heating data "0000 0010" is stored in EPROM 93 for a plain paper printing mode, then, heating data "0000 0100" is stored in EPROM 93 for an OHP film printing mode.

Accordingly, in an OHP film printing mode, the pulse width of the strobe signal, which indicates the heating time, is wider than in a normal printing mode. The strobe signal (STB) is applied to TPH 100 in response to the output data of EPROM 93 of middle gradation converter 90. As a result, more energy is provided for an OHP film printing mode than for a normal printing mode.

In addition, if general purpose computer 120 is connected online to micro-computer 130, the digital signal applied via general purpose computer 120 is printed after performing the above-described procedures according to the printing mode.

Another conventional thermal printer, which varies a strobe signal according to the type of print media, is disclosed in U.S. Pat. No. 4,795,999. The printer disclosed therein automatically selects a heating time having the optimum heating value for each heating element according to the print media used, i.e., plain printing paper or OHP film.

FIG. 7 is a schematic block diagram showing a thermal printer which varies the heating energy by varying the repetition of print cycles in dependence upon the print mode and the print media used. Components of the printer of FIG. 7 which are the same as those of FIG. 5 are denoted by the same reference numerals, and explanation thereof will be omitted. The device shown in FIG. 7 operates as follows. If an OHP film printing mode is selected by key controller 110 or general purpose computer 120, micro-computer 130 controls a print mechanism portion 200 to perform the printing procedure for a normal printing mode twice in response to the above selection.

When an OHP film is inserted, first sensor 150 senses the presence of the OHP film and sends a signal to the micro computer 130 indicating this presence. Here, print mechanism portion 200 comprises the TPH 100 and directly performs a printing operation. In this case, unlike the case of FIG. 6, the effect of actually extending the heating time (t) is obtained by repeating the printing procedure.

Further, in an OHP film printing mode, the heating energy can be enlarged by raising the voltage supplied from power supply 140 as in FIG. 5 and by simultaneously controlling the heating time as in FIG. 6. In addition, a sublimation film exclusively used for OHP film and exhibiting a high degree of heating under the same applied heating energy can be used.

However, if the appropriate sublimation film for a given print media and a predetermined printing mode is used, this cannot be recognized by the conventional systems. As a result, the predetermined printing mode is performed as it is, and a print having a low density and low screen quality is obtained, which deviates from the user's desire. Therefore, re-printing has to be performed.

A printer disclosed in U.S. Pat. No. 4,795,999 has different printing methods for each printing mode by varying the heating time depending on the printing media. However, a printing method which automatically varies depending on the kind of the dye-deposited sublimation film is unavailable.

SUMMARY OF THE INVENTION

Accordingly, it is an object of the present invention to provide a thermal printer which senses both the print media and the sublimation film, (also called the printing film) and checks if the media and printing film are appropriate for the selected printing mode and performs a printing operation in an optimum state based on the result.

It is another object of the present invention to provide a printing method suitable for the above-described thermal printer.

To accomplish the above-described object, there is provided a thermal printer having a thermal print head, a print medium, and a cartridge containing printing film having a thermally sublimatable dye deposited thereon, the print medium and the printing film being selected from among at least two kinds of print medium and at least two kinds of printing films. Printing is performed by emitting heat to sublimate the ink deposited on the printing film in a pattern suitable for printing data or images on the printing medium. The thermal printer comprises:

a first sensor for sensing the kind of print medium provided;

a second sensor for sensing the kind of printing film provided; and a heating energy controller for controlling the heating energy of the thermal print head, in accordance with the sensed results.

There is further provided a method for a thermal printer having a thermal print head, a print medium, and a cartridge containing printing film having a thermally sublimatable dye deposited thereon, the print medium and the printing film being selected among at least two kinds of print media and printing films. The method performs printing by emitting heat in order to sublimate the ink deposited on the printing film onto the print medium in a pattern suitable for printing data, the method comprises the steps of:

sensing the kind of print medium;

sensing the kind of printing film; and controlling the heating energy of the thermal printer head in accordance with the sensed results.

DETAILED DESCRIPTION OF THE INVENTION

The present invention will be explained in detail with reference to the attached drawings.

Figure 1:
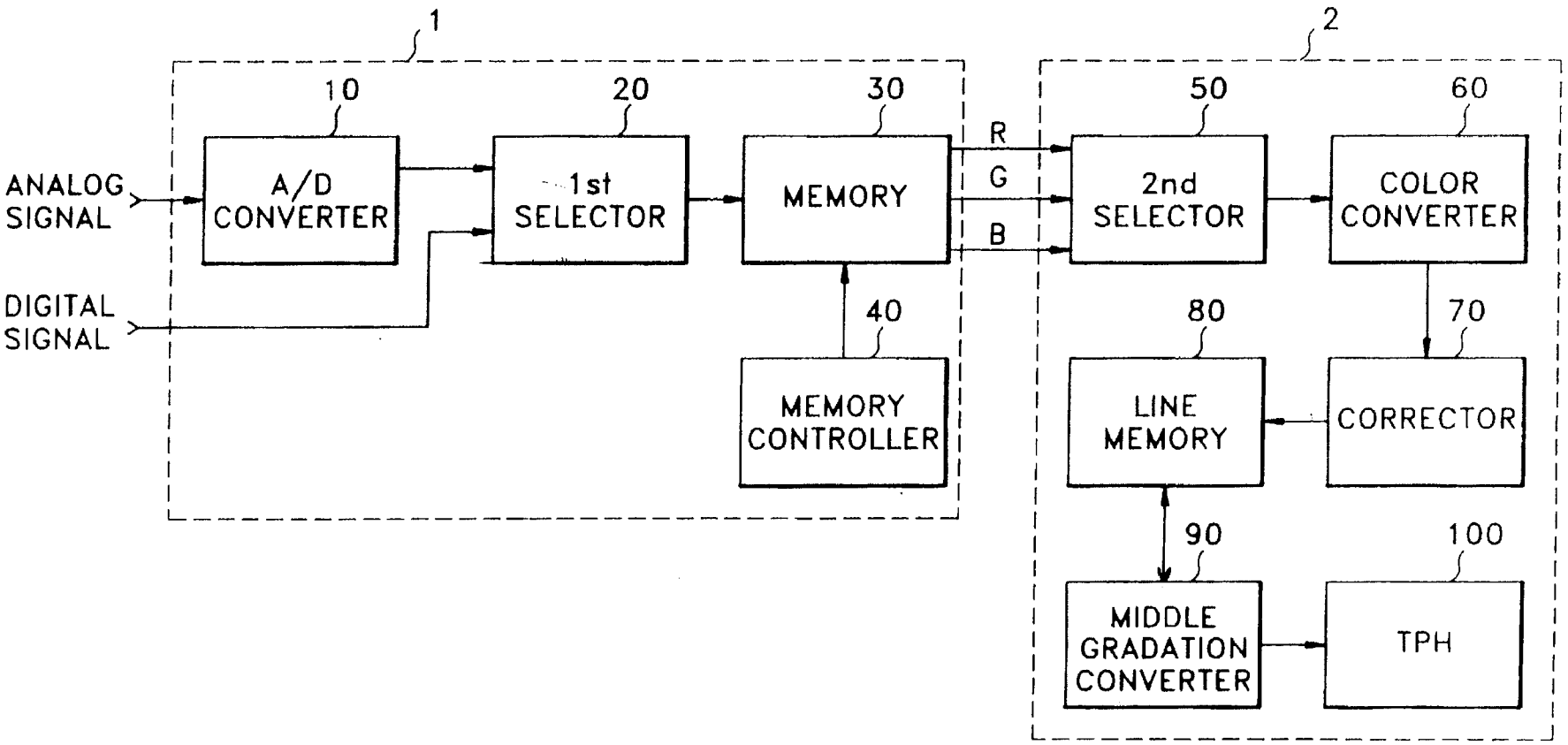
FIG. 1 (PRIOR ART)
FIG. 1 is a block diagram showing a general conventional thermal printer.
Figure 2:
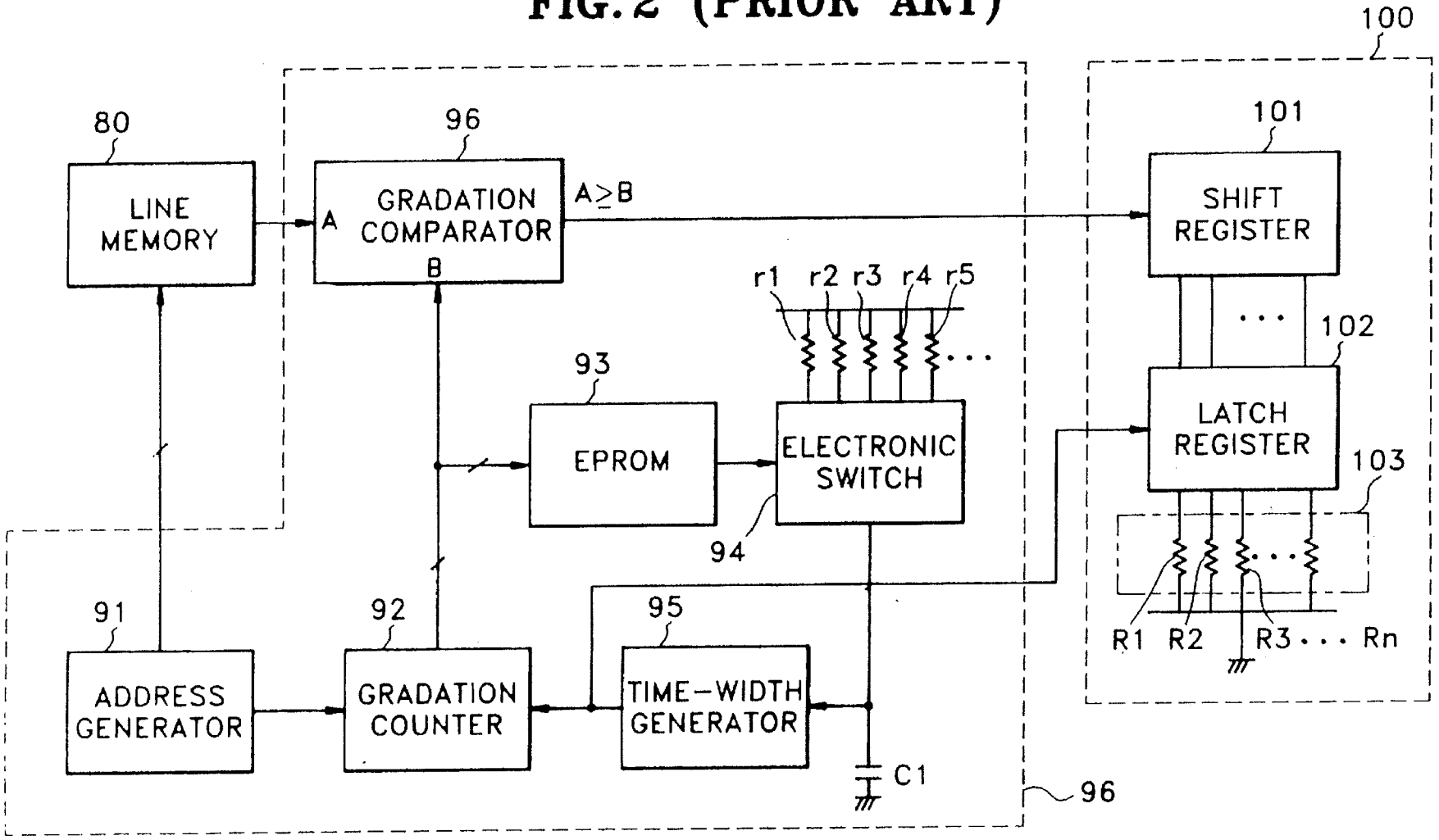
FIG. 2 (PRIOR ART)
FIG. 2 is a block diagram of a middle gradation converter and thermal print head shown in FIG. 1.
Figure 4:
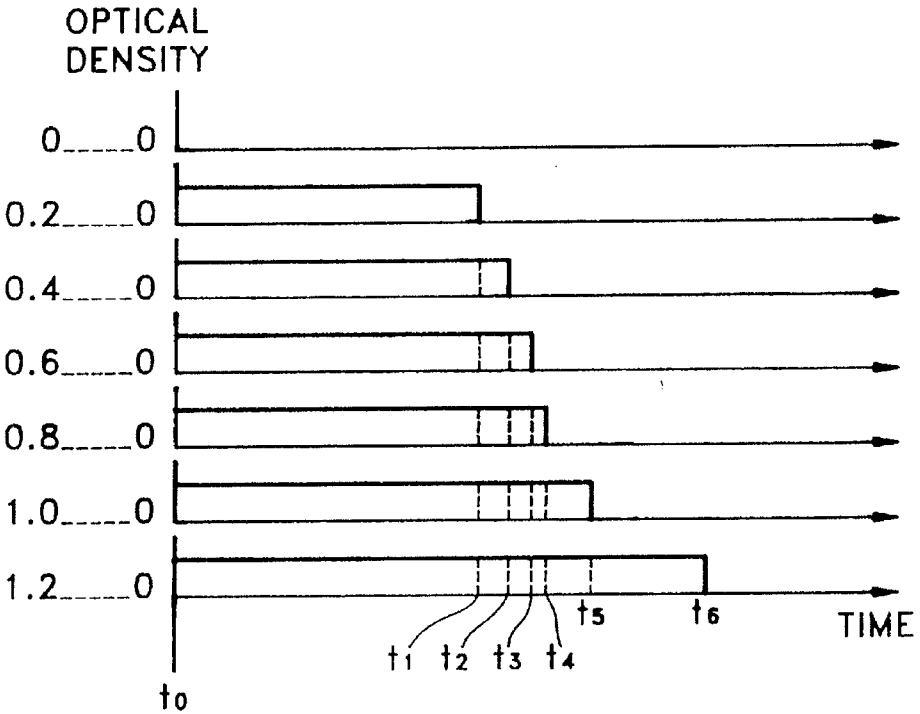
FIG. 4 (PRIOR ART)
FIG. 4 is a graph illustrating the relation between optical density and heating time of a thermal print head shown in FIG. 1.
Figure 3:
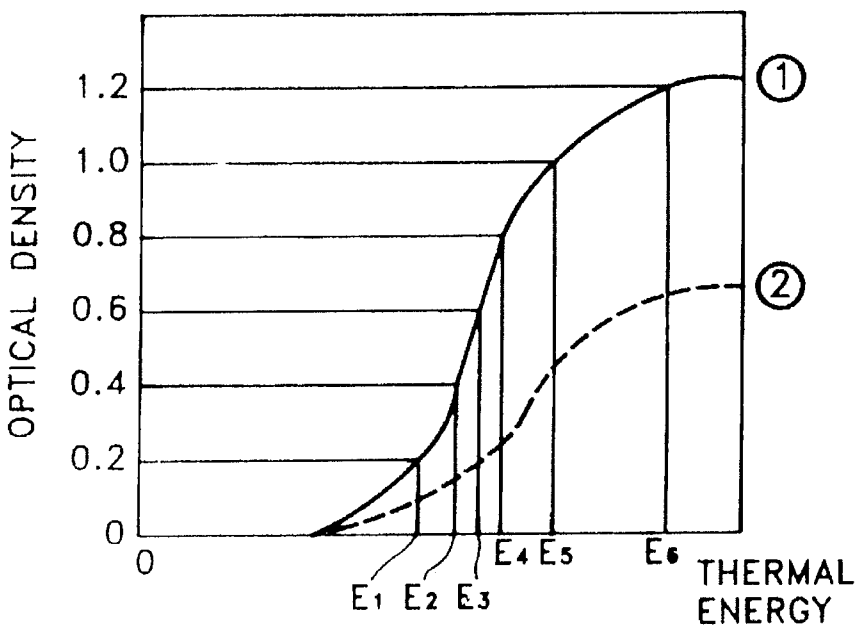
FIG. 3 (PRIOR ART)
FIG. 3 is a graph showing a sensitivity of a printing film.
Figure 5:
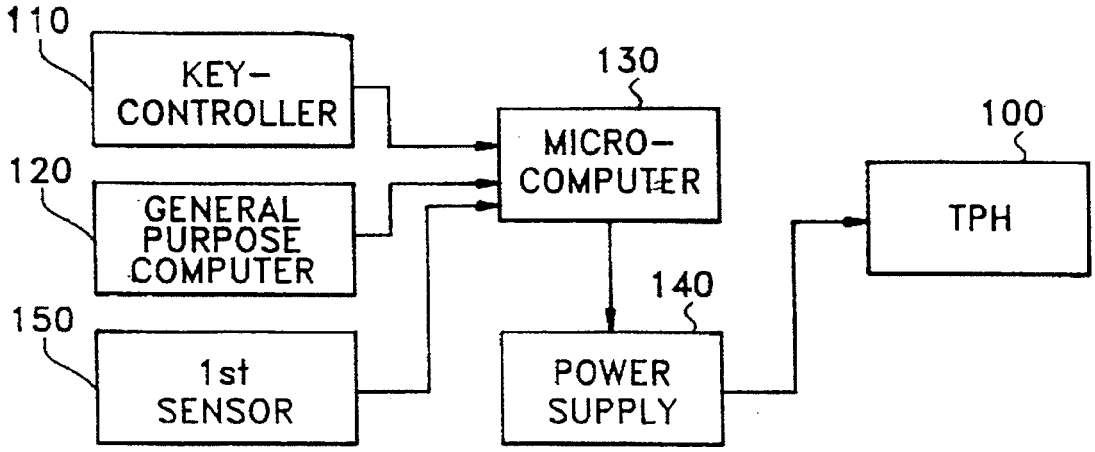
FIG. 5 (PRIOR ART)
FIG. 5 is a schematic block diagram showing a thermal printer which controls the supply voltage of the TPH in accordance with a selected film printing mode.
Figure 6:
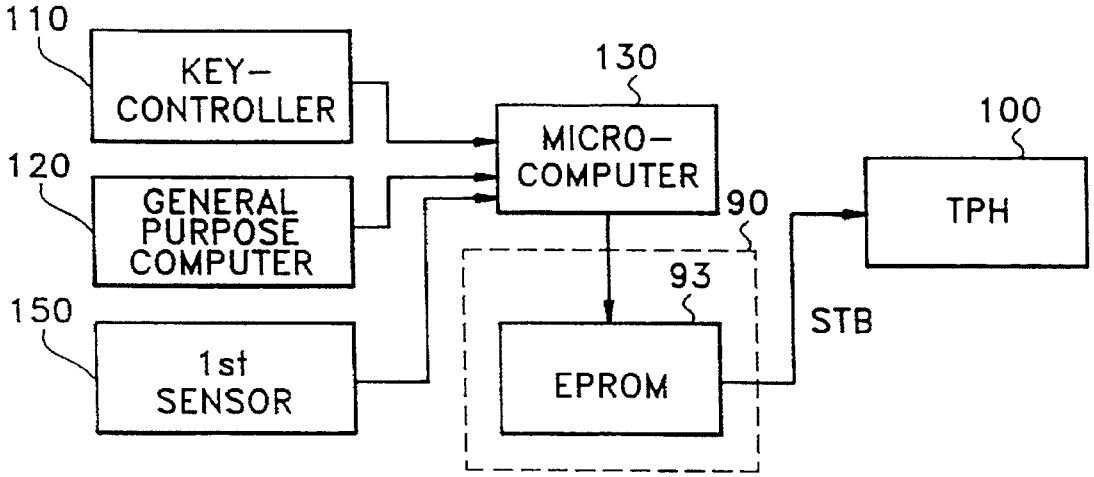
FIG. 6 (PRIOR ART)
FIG. 6 is a schematic block diagram showing a thermal printer which controls the heating time of the TPH in accordance with a selected film printing mode.
Figure 7:
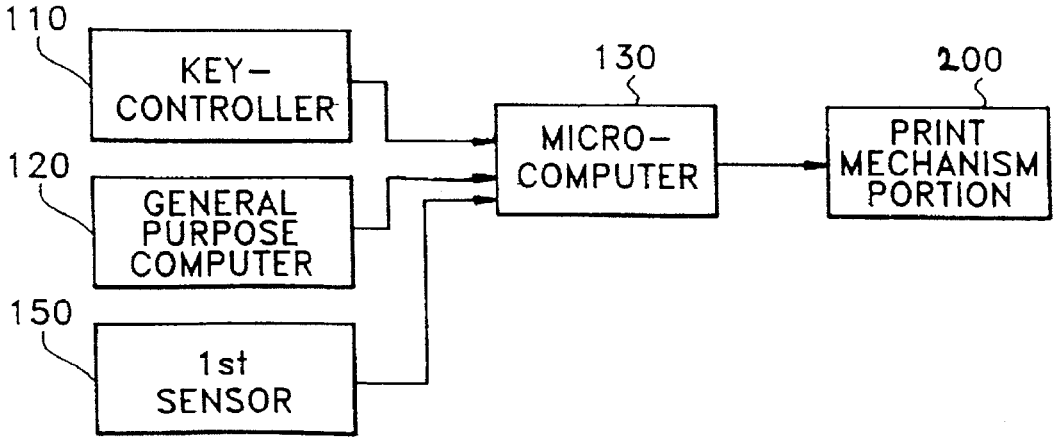
FIG. 7 (PRIOR ART)
FIG. 7 is a schematic block diagram showing a thermal printer which controls the repetition of the printing procedure in accordance with the selected film printing mode.
Figure 8:
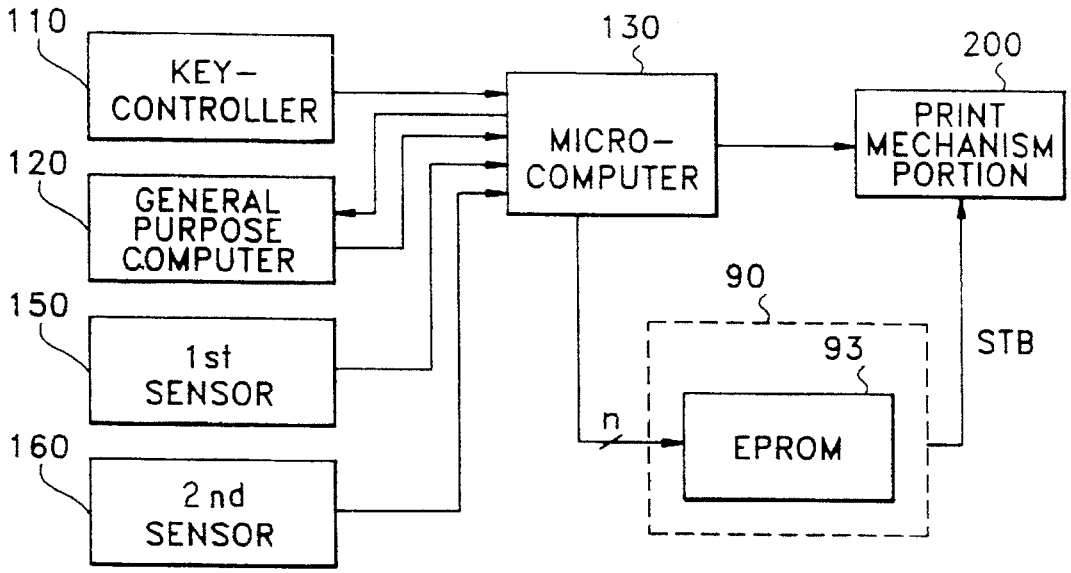
FIG. 8 is a block diagram of a preferred embodiment of a thermal printer according to the present invention.

FIG. 8 is a block diagram of an embodiment of a thermal printer of the present invention. The device shown in FIG. 8 includes a key controller 110 for selecting a normal printing mode, (hereinafter, called a "normal mode") where a printing operation is performed by employing a plain paper print medium and a plain printing film, and an OHP printing mode, (hereinafter, called an "OHP mode") where a printing operation is performed by employing an OHP print medium and an OHP printing film, and a general purpose computer 120 for providing a digital image signal and for informing a user whether the state of the current printing film and the provided print medium is suitable for a predetermined printing mode. It will be noted that the plain printing film is particularly suitable for printing on plain paper, and the OHP printing film is particularly suitable for printing on print medium which is OHP film.

In addition, the device shown in FIG. 8 includes first and second sensors 150 and 160 for respectively sensing the supplied print media and the printing film. Micro-computer 130 generates a control signal after determining if the key signal input from key controller 110 corresponds with the signals from first and second sensors 150 and 160 and outputs the resultant control signal to general purpose computer 120.

A print mechanism portion 200, which is provided with the TPH 100 and which performs a printing operation, is connected to an output terminal of micro-computer 130. The middle gradation converter 90, in which EPROM 93 is provided, generates a Strobe signal and is connected between micro-computer 130 and print mechanism portion 200. Here, middle gradation converter 90 can be replaced by a strobe signal generator for generating a strobe signal for each printing gradation.

The device shown in FIG. 8 operates as follows. When a print medium is supplied to a paper supplier (not shown), such as a paper tray or the like, the first sensor 150 senses if the supplied medium is an OHP film or plain paper.

When the reflection rate of light is used to discriminate plain paper from OHP film, experimental results indicate that the reflection rate for plain paper is approximately 95% while the reflection rate for OHP film is approximately 70%. When the first sensor 150 senses the kind of the print medium supplied, the sensing signal is applied to micro-computer 130. One example of the detailed constitution and operation for first sensor 150, which employs the reflection rate of light, is disclosed in the above-mentioned U.S. Pat. No. 4,795,999. When the transmission of light is used, the characteristic that light is hardly transmitted through plain paper while light easily transmits through an OHP film may be utilized.

Second sensor 160 senses if the currently provided cartridge is wound with an OHP exclusive use printing film or with a plain printing film. When the kind of the printing film wound into the cartridge is sensed by second sensor 160, the sensed signal is provided to micro-computer 130. The general printing film cartridge and the OHP printing film cartridge are designed differently to permit the sensor to distinguish the different types of printing films by detecting the differences in the cartridges that house the different types of printing films.

Figure 9:
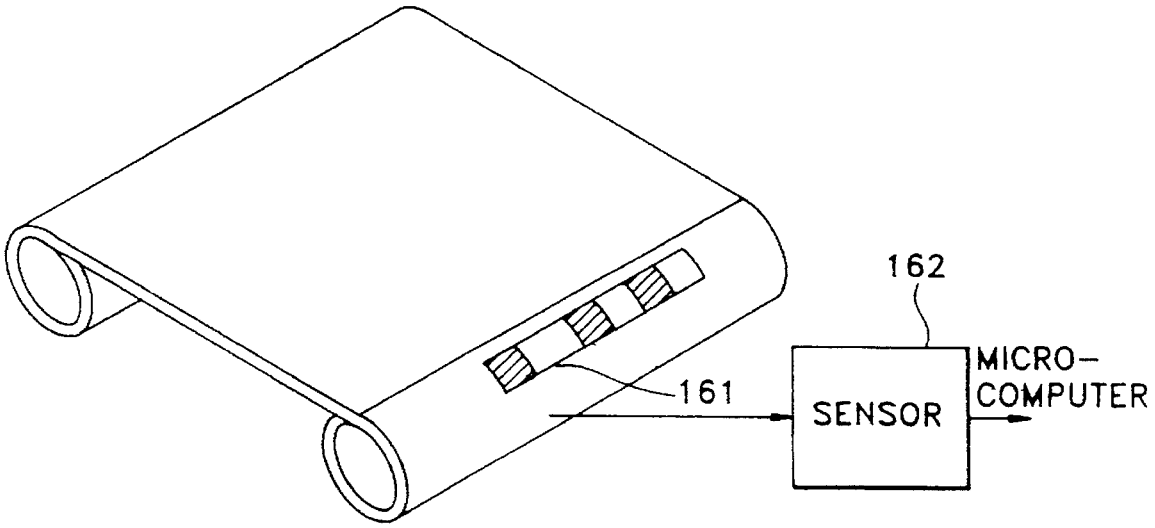
FIG. 9 illustrates an embodiment of a second sensor shown in FIG. 8.

For example, a bar code 161 may be applied to a cartridge housing an OHP printing film, as shown in FIG. 9, to distinguish it from a non bar-coded cartridge used to house plain printing film. The black and white bar markings of bar-code 161 can be read by sensor 162. Additionally, the use of bar coding allows sensor 162 to sense various kinds of printing films and is not limited to merely sensing the presence or absence of a bar code. The sensor 162 constitutes one example of sensor 160 of FIG. 8.

Figure 10A:
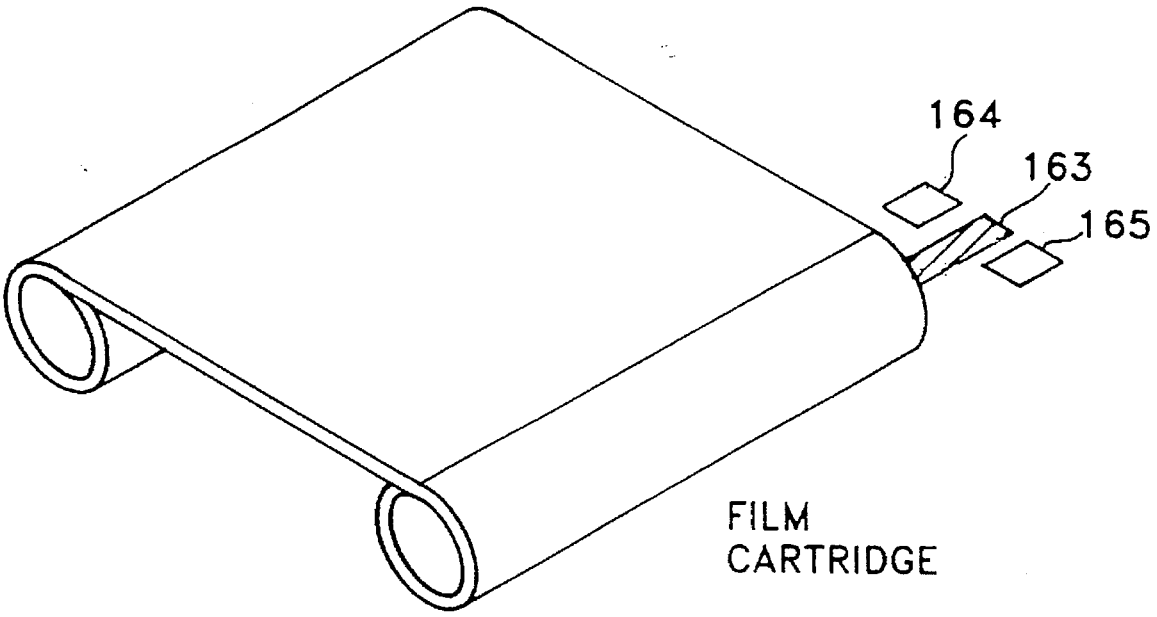
FIG. 10A and FIG. 10B illustrate another embodiment of a second sensor shown in FIG. 8.

Alternatively, the shape of the film cartridge can be modified, as shown in FIG. 10A, to distinguish cartridges housing OHP printing film from those housing plain printing film. In the embodiment of FIG. 10A, a predetermined shaped protrusion 163 is provided on a film cartridge so that when the cartridge is inserted in the printer, protrusion 163 is located between light emitter 164 and light receiver 165 of second sensor 160. Thus, for example, a film cartridge having protrusion 163 is one wound with an OHP printing film while a film cartridge without a protrusion is one wound with a plain paper printing film, enabling the second sensor to discriminate between the two types of printing films.

If the film cartridge has a protrusion 163, the light output from light emitter 164 is cut off by the protrusion 163 and is not irradiated onto light receiver 165. If the film cartridge has no protrusion, the light irradiated from light emitter 164 is delivered to light receiver 165.

Figure 10B:
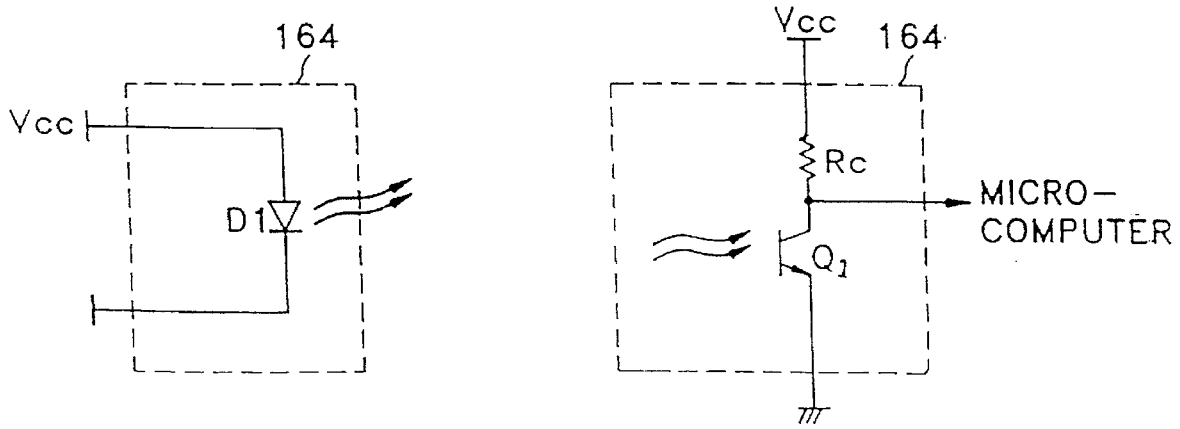

As shown in FIG. 10B, in light emitter 164 and light receiver 165, the light output from light emitter 164, constituted by a light emitting diode D1, will not irradiate the base of photo-transistor Q1 of light receiver 165 if the film cartridge is provided with a protrusion. Therefore, photo-transistor Q1 is turned "off" and the signal input to micro-computer 130 is a "high" signal. If a film cartridge is not provided with a protrusion, photo-transistor Q1 is turned "on" since the light output from the light emitting diode D1 irradiates the base of photo-transistor Q1. Therefore, the signal input to micro-computer 130 is a "low" signal. Accordingly, micro-computer 130 determines whether an OHP printing film or a plain paper printing film is loaded in the printer, depending on the "low" or "high" signal output from second sensor 160.

Thus, first sensor 150 and second sensor 160 sense the kind of print medium provided and the kind of printing film provided in the cartridge. Micro-computer 130 compares the printing mode established by key controller 110 with the sensor signals so as to determine if the mode and the sensor signals correspond or not. The printing mode is established via key controller 110 and general purpose computer 120.

Signals indicating the perceived mode, media and printing film are delivered to general purpose computer 120. If the sensor signals and the established printing mode do not correspond, this information is delivered to the user by the computer 120, and the user then determines if the printing operation should proceed by referring to the state displayed by general purpose computer 120.

The relationship between the mode, media and printing film and the user decision is explained by the following four examples.

(a) An OHP mode is set, and OHP printing medium and plain printing film are provided in the printer;

The kind of printing medium and printing film currently sensed is transmitted to general purpose computer 120 by micro-computer 130, where a sensing signals representing the OHP printing medium and the plain printing film sensed by first and second sensors 150 and 160 are provided. The computer 120 provides an indication to the user, which, in effect, requests the user to determine whether the printing operation should proceed.

In this case, even though the OHP film has a lower sensitivity than plain paper, if the user inputs a command for the printing to proceed via key controller 110 or general purpose computer 120, the printing operation is performed twice by print mechanism portion 200 under the control of micro-computer 130. Accordingly, the overall heating energy supplied to the TPH is increased by means of extending the overall strobe signal duration when OHP printing is performed. That is, as shown in expression (1), heating energy increases when the heating time (t), i.e., strobe signal duration, is extended.

Print mechanism portion 200 repeatedly performs the printing procedure according to the control signal supplied from micro-computer 130, to thereby compensate for a low printing density or low screen quality output.

(b) An OHP mode is set, an OHP medium is loaded, the user is provided with a cartridge having plain paper film and a cartridge having OHP printing film, and mistakenly loads the cartridge having plain printing film;

A control signal for indicating the kind of the current printing film and printing medium is supplied from micro-computer 130 to general purpose computer 120, to thereby inform the user of the discrepancy and require the user's decision whether the printing operation is to proceed.

Micro-computer 130 may then be supplied with a printing stop signal by the user via key controller 110 or general purpose computer 120, and the user may then pull out the OHP printing medium and supply plain printing paper medium and change the mode to the normal printing mode and thereafter print in a normal mode.

Otherwise, the user can replace the cartridge having the plain printing film with the cartridge having an OHP printing film, which is sensed, together with the printing medium loaded, by first and second sensors 150 and 160. The sensed signals are applied to micro-computer 130. Micro-computer 130 re-transmits the perceived result to general purpose computer 120 thereby to request the user to determine if the printing operation is to proceed or not. When the command for proceeding with the printing operation is supplied from the user, the strobe signal for an OHP mode is read from middle gradation converter 90 and delivered to print mechanism portion 200. Then, micro-computer 130 outputs an operation signal to print mechanism portion 200. Thus, high quality printing is possible by performing the printing operation only once.

(c) A normal printing mode is set under the same state as example (a);

This is for the case when an OHP printing medium and a plain printing film are loaded even though an OHP mode printing operation is not wanted.

An indication of the current printing film and medium sensed is transmitted from micro-computer 130 to general purpose computer 120 to request the user to decide whether or not the printing operation is to proceed. If a stop command is delivered from the user, the OHP printing medium is ejected. The printing operation may be started again after OHP medium is replaced with a plain paper medium. First and second sensors 150 and 160 sense the kind of the printing film and medium at that time. The strobe signal for a normal mode printing is read from middle gradation converter 90 if the printing film and the printing media are both plain. Micro-computer 130 sends a signal to print mechanism portion 200. As a result, high quality printing is made possible by printing only once.

(d) A plain paper and OHP printing film are provided in the OHP printing mode, which is opposite to example (a);

When first and second sensors 150 and 160 sense a plain paper and an OHP printing film, micro-computer 130 transmits an indication of the paper and the printing film detected to general purpose computer 120. General purpose computer 120 requests a user input as to whether or not the printing operation should proceed. When the printing proceed signal input is supplied by the user, the printing operation is performed under the condition where the plain paper and OHP printing film are loaded.

At this time, micro-computer 130 reads strobe signal data that represents a heating time stored in a look-up table of EPROM 93 and corresponding to the OHP printing film and the plain paper. Here, at least the strobe data is stored in EPROM 93 for the cases of (a) plain print medium and plain printing film (b) OHP print medium and OHP printing film, and (c) plain print medium and OHP printing film.

TPH 100 of print mechanism portion 200 emits heat to the printing film in response to the strobe (STB) signal output from middle gradation converter 90.

For the case of printing on the plain print medium using an OHP printing film, a strobe signal having a heating time shorter than that of the normal mode for printing with plain printing film on plain paper is generated. As a result, a printing operation is performed by reducing the heating energy. Therefore, high quality printing is possible and the printing time can be reduced.

Figure 11:
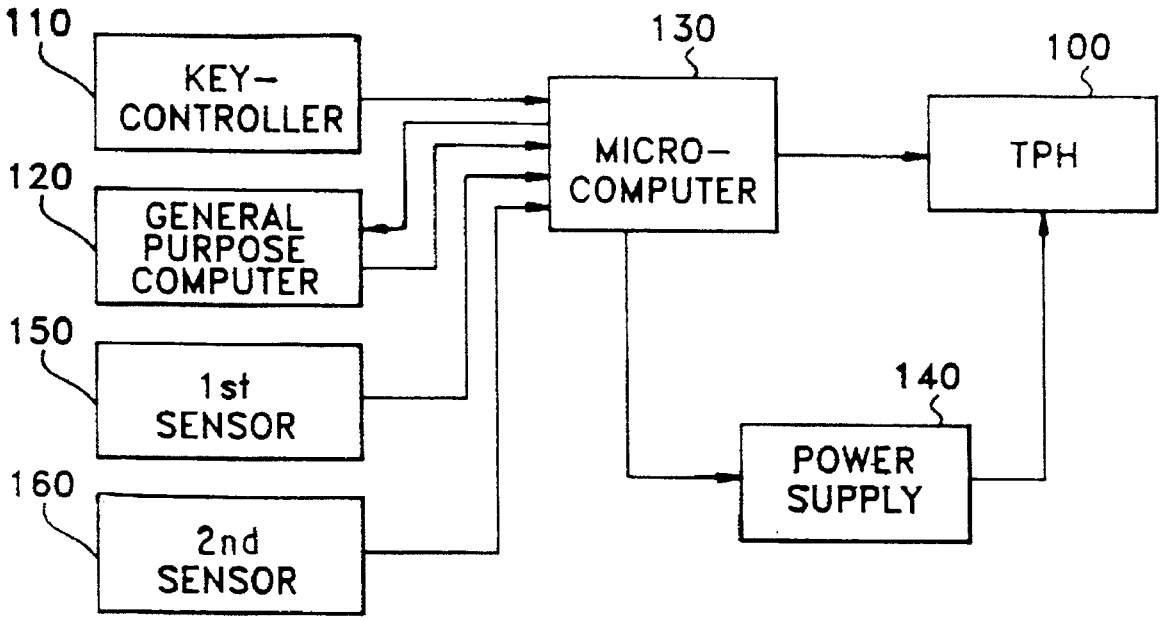
FIG. 11 is a block diagram of another preferred embodiment of a thermal printer according to the present invention.

FIG. 11 is a block diagram of a thermal printer of another embodiment of the present invention, wherein the components of the printer of FIG. 11 which are the same as those in FIG. 8 have the same reference numerals, and explanation of those components will be omitted.

A power supply 140 for varying the output voltage thereof in accordance with a predetermined control signal supplied thereto is connected to an output terminal of micro-computer 130. TPH 100 is connected to the output terminal of power supply 140. The device shown in FIG. 11 operates as described in the following two examples.

(a) for the case of plain printing film and an OHP printing medium.

This is for the case where the printing film wound into a cartridge loaded in the printer is a plain printing film and the printing medium loaded in the paper supplier is an OHP film. First and second sensors 150 and 160 sense the current printing film and media and the result of such sensing is supplied to micro-computer 130. Micro-computer 130 transmits the result to general purpose computer 120, to thereby inform the user. When the printing proceed signal is supplied by the user, micro-computer 130 controls power supply 140 which provides driving power to TPH 100 so that an output voltage of power supply 140 can be increased. Power supply 140 controls the voltage provided to TPH 100 within an absolute maximum rated voltage.

(b) for the case of an OHP printing film and a plain print medium.

In this case the micro-computer 130 controls power supply 140 to lower the output voltage if a printing proceed signal is applied by the user.

Accordingly, for the cases of (a) and (b), TPH 100 controls the amount of the heating according to the output voltage of power supply 140 which is varied in response to the control signal supplied from micro-computer 130, to thereby perform a printing operation without degrading the image quality.

Here, according to the result of the sensing by first and second sensors 150 and 160, the user can select a printing film or a printing medium appropriately for a printing mode so as to perform a printing operation in a desired printing mode.

Figure 12:
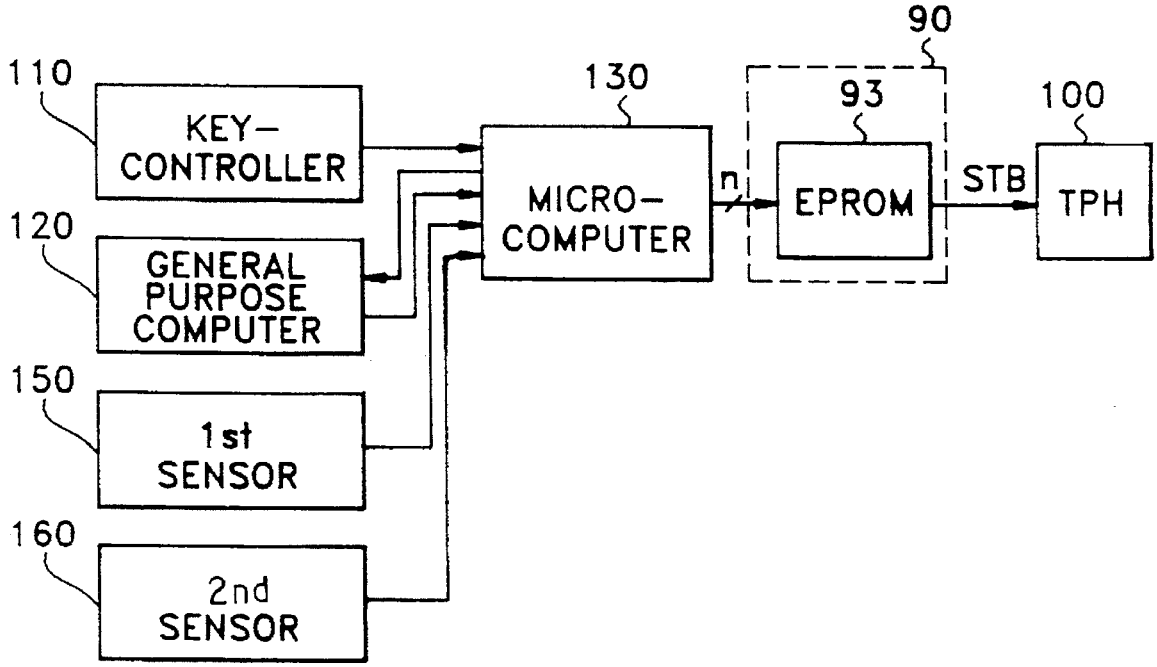
FIG. 12 is a block diagram of still another preferred embodiment of a thermal printer according to the present invention.

FIG. 12 is a block diagram of another embodiment of a thermal printer of the present invention, wherein components of the printer of FIG. 12 which are the same as those in FIG. 8 have the same reference numerals, and an explanation of those components will be omitted.

An output terminal of micro-computer 130 is connected to middle gradation converter 90 which includes EPROM 93, and an output terminal of middle gradation converter 90 is connected to TPH 100. The user sets a printing mode via key controller 110, which is recognized by micro-computer 130.

First sensor 150 senses the kind of printing medium loaded in the paper supplier and the result is applied to micro-computer 130. Second sensor 160 senses the kind of printing film wound on a film cartridge, and the result is applied to micro-computer 130. Micro-computer 130 compares the set printing mode with the results of the sensing of first and second sensors 150 and 160, and controls the strobe data suitable for the printing mode and which is stored in EPROM 93 to be read therefrom if the mode and the result are the same.

If the mode and the result of the sensing are not the same, the result of the sensing is sent to general purpose computer 120, to thereby request a user input as to whether or not to proceed with the printing operation. The user sends the determination on whether or not to proceed with the printing to micro-computer 130 via key controller 110 or general purpose computer 120.

When the printing proceeding signal is applied to micro-computer 130, a control signal is generated by using the current paper and printing film so as to print in the set printing mode. Data corresponding to the number of cases of each kind of media and printing film is stored in EPROM 93. That is, the strobe data for the case of 1) plain paper and printing film, 2) OHP medium and OHP printing film, 3) plain paper and OHP printing film, and 4) OHP medium and plain printing film is stored in EPROM 93.

As an example, we will assume that printing will be performed with a plain printing film on an OHP medium and in an OHP mode. As shown in FIG. 12, micro-computer 130 outputs a control signal to EPROM 93 so that the heating time can be controlled by varying the duration of a strobe signal instead of performing the printing twice. The strobe data relevant to the above case 4) is read from EPROM 93 and provided to TPH 100. As a result, heating time is extended and heating energy is increased.

As another example, we will assume that printing is performed with an OHP printing film on a plain paper and in an OHP mode. Here, the strobe data relevant to the above case 3) stored in EPROM 93 is read and provided to TPH 100, which shortens the heating time. As a result, the heating energy is decreased.

Here, the user can change the printing film or media suitable for a printing mode according to the result of the sensing of first and second sensors 150 and 160, to thereby print in a desired printing mode.

Figure 13:
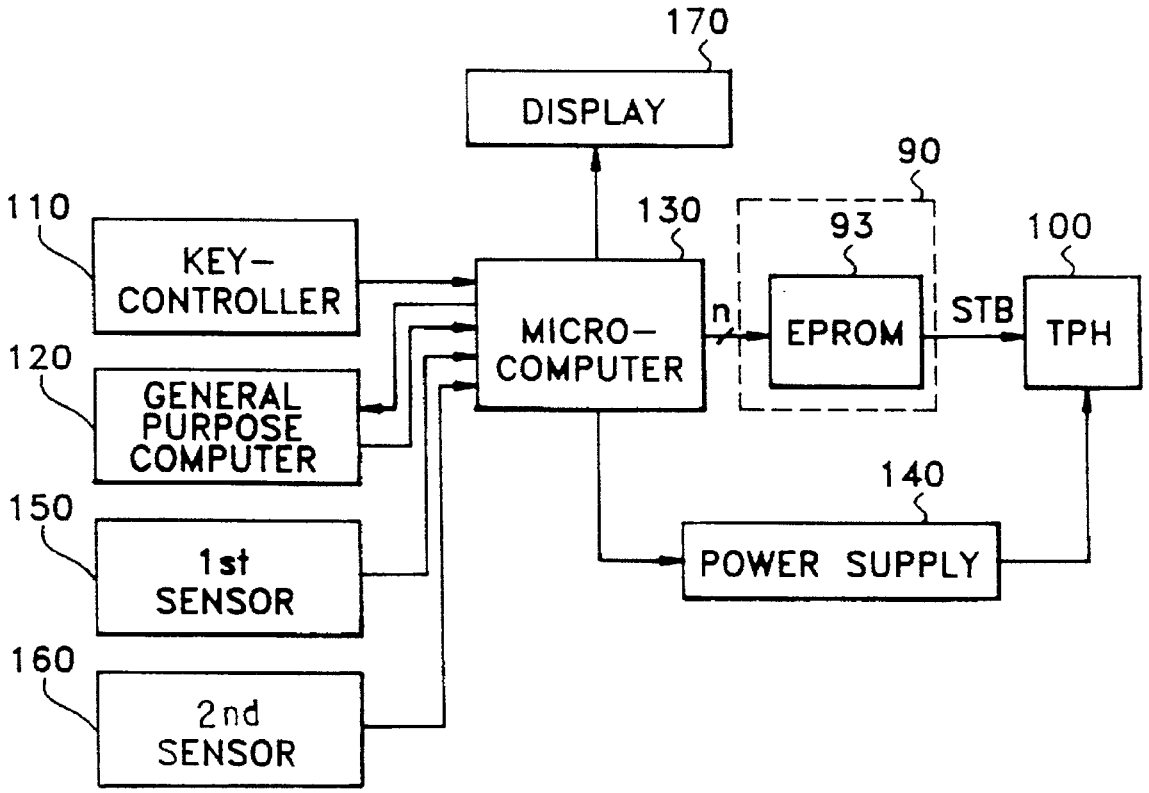
FIG. 13 is a block diagram of still another preferred embodiment of a thermal printer according to the present invention.

FIG. 13 is a block diagram of another embodiment of a thermal printer of the present invention, wherein components of the printer of FIG. 13 which are the same as those in FIG. 8 have the same reference numerals, and an explanation of those components will be omitted.

An output terminal of micro-computer 130 is connected to middle gradation converter 90 provided with EPROM 93 and another output terminal of micro-computer 130 is connected to the input terminal of power supply 140. Input terminals of TPH 100 are respectively connected to output terminals of middle gradation converter 90 and power supply 140.

A display 170 constituted of an LCD is connected to an output terminal of micro-computer 130. Display 170 can also be added to the configurations of FIGS. 8, 11 and 12.

The device shown in FIG. 13 operates as follows. When printing is to be performed with a plain printing film and an OHP medium in OHP mode, the heating time can be increased by performing the printing after increasing the voltage of power supply 140 simultaneously with the control of the time width of the strobe signal instead of performing the printing operation twice as described with reference to FIG. 8 and merely controlling the strobe signal as shown in FIG. 12.

As an example, we will assume that printing is to be performed with plain printing film on OHP medium in OHP mode. The strobe data for the case of an OHP medium and plain printing film stored in a look-up table of EPROM 93 is provided to TPH 100, and the voltage of power supply 140 is increased so as to increase the heating energy.

As another example, we will assume that printing is to be performed by a plain paper with an OHP printing film. The strobe data for the case of plain paper media and OHP printing film stored in a look-up table of EPROM 93 is provided to TPH 100, and the voltage of power supply 140 is decreased so as to decrease the heating energy. Here, the variable scope of the voltage provided from power supply 140 lies within the absolute maximum rated voltage. In addition, the user can change the printing film or media suitable for a printing mode according to the result of the sensing by first and second sensors 150 and 160, thereby printing in a desired printing mode.

Moreover, if the printing mode set by key controller 110 or general purpose computer 120 is different from the result of the sensing of first and second sensors 150 and 160, micro-computer 130 can display the error via display 170 using LCD or by using a monitor of general purpose computer 120.

As described above, the thermal printer of the present invention and the method thereof makes it possible to check if a set printing mode corresponds to the kind of the currently provided medium and printing film prior to performing the printing operation. As a result, a printing operation in an optimum state according to the user's desire without re-printing caused by an operation error is made possible. Furthermore, the heating of the printing elements in the thermal print head may be controlled in accordance with the sensed print media and the sensed printing film, and this heating may be varied in several ways, such as varying the supplied voltage to the print head, varying the duration of applied heat in a single printing operation, varying the repetition of printing operations, and combinations thereof.

As used in the claims following, the term "data" is intended to mean generically data, image or picture.

What is claimed is:

1. A thermal printer having a thermal print head, a printing medium, and a cartridge provided containing printing film having a thermally sublimatable dye deposited thereon, said printing medium and said printing film being selected among at least two kinds of printing media and printing films, the thermal printer performs printing by emitting heat in a pattern suitable for printing data on said printing medium in order to sublimate the dye deposited on said printing film, the thermal printer comprising:

first sensing means for sensing which of said at least two kinds of media is provided;

second sensing means for sensing which of said at least two kinds of printing film is provided;

means for storing heating energy amounts, each of said heating energy amounts corresponding to a specific combination of one of said at least two types of printing media and one of said at least two types of printing film;

means for selecting one of said stored heating energy amounts based on said sensings of said first sensing means and said second sensing means; and heating energy controlling means for controlling a heating energy of said thermal print head in order to sublimate the dye deposited on said printing film, in accordance with said selected one of said stored heating energy amounts.

2. A thermal printer according to claim 1, wherein said kinds of printing media are plain papers and transparent film and overhead projector (OHP) said kinds of printing film are a printing film for printing on plain paper and a printing film for printing on OHP transparent film.

3. A thermal printer according to claim 1, wherein said first sensing means sense or of a light transmission and a reflection rate of light with respect to the printing medium.

4. A thermal printer according to claim 1, wherein said second sensing means sense which of said at least two kinds of printing film is currently provided by sensing a bar-code of said cartridge and reading information of the bar-code.

5. A thermal printer according to claim 1, wherein said second sensing means sense a shape of said cartridge of which the shape varies depending on which of said at least two kinds of printing film is contained therein so as to sense which of said at least two kinds of printing film is currently provided.

6. A thermal printer according to claim 1, wherein said each of said stored heating energy amounts designates repeating a printing process.

7. A thermal printer according to claim 1, wherein said heating energy controlling means comprise a power supply for varying a supply voltage thereof in accordance with the selected one of said stored heating energy amounts and for outputting a supply voltage to said thermal print head.

8. A thermal printer according to claim 1, wherein said heating energy controlling means comprise a strobe signal generator for varying a strobe signal which corresponds to said selected one of said stored heating energy amounts for outputting the strobe signal to said thermal print head.

9. A thermal printer according to claim 1, further comprising a display means for displaying first information of a state of a currently provided printing medium and printing film in accordance with the sensing performed by said first sensing means and the sensing performed by said second sensing means and for displaying second information of a state of the sensing performed by said first sensing means and the sensing performed by said second sensing means when a result of the sensings is different from a set printing mode.

10. A thermal printer according to claim 9, wherein the provided printing medium is ejected from the printer when a user applies a printing stop signal in accordance with at least one of the first and second information displayed by said display means.

11. A thermal printing method using a printer having a thermal print head, a printing medium, and a cartridge provided containing printing film, having a thermally sublimatable dye deposited thereon, said printing medium and said printing film being selected among at least two kinds of printing media and printing film, which performs printing by emitting heat in order to sublimate the dye deposited on said printing film onto said printing medium in a pattern suitable for printing data, said thermal printing method comprises the steps of:

sensing firstly which of said at least two kinds of printing media is to be printed upon;

sensing secondly which of said at least two kinds of printing film is provided in said cartridge;

storing heating energy amounts corresponding to which of said at least two kinds of printing media and which of said at least two kinds of printing film are provided;

selecting one of said stored heating energy amounts based on said sensings of said first sensing step and said second sensing means;

controlling a heating energy of said thermal print head in accordance with the selected stored heating energy amount; and causing said thermal head to print in accordance with the controlling step.

12. A thermal printing method using a thermal printer having a thermal print head for printing data on a printing medium by controllably heating a printing film having a thermally sublimatable dye deposited thereon to sublimate the dye deposited on said printing film onto said printing medium in a pattern suitable for printing data, said printing film being wound within a cartridge, said printing medium and said printing film being selected from among at least two kinds of printing media and printing films associated with said thermal printer, said thermal printing method comprising the steps of:

sensing firstly which one of said at least two kinds of printing media on which said data is to be printed;

sensing secondly one of said at least two kinds of printing film is provided in said cartridge;

determining whether the one sensed medium and film are suitable for a predetermined printing mode;

performing a printing operation specific to a combination of the one sensed medium in the sensing step and the one sensed film in the second sensing step, according to said predetermined printing mode if a result of said determining step is that said one sensed medium and film are suitable for said predetermined printing mode; and displaying said result of said determining step and awaiting instruction from a user as to whether or not to proceed with the printing operation if the result of said determining step is that said one sensed medium and film are not suitable for the predetermined printing mode.

13. The printing method of claim 12, further comprising;

ejecting the said medium when a printing stop signal is applied by a user and substituting a different kind of printing medium on which said data is to be printed; and proceeding with the printing operation.

14. A printing method according to claim 13, wherein said printing medium is selected from among a plain paper and an overhead projector (OHP) transparent film and said printing film is selected from among a printing film for printing on a plain paper and a printing film for printing on an OHP transparent film.

15. A printing method according to claim 13, wherein said step for performing said printing operation comprises:

controlling a heating energy applied to said print head in accordance with which of said at least two kinds of printing media is sensed in the printing media sensing step and which of said at least two kinds of printing film is sensed in the printing film sensing step.

16. A printing method as claimed in claim 15, wherein the step of controlling the heating energy comprises controlling a number of repetitions of said printing operation performing step.

17. A printing method according to claim 15, wherein said step for controlling said heating energy comprises varying a level of voltage supplied to heat said thermal print head.

18. A printing method according to claim 15, wherein said step for controlling said heating energy comprises controlling a duration of a strobe signal applied to heat said thermal print head.

19. A printing method according to claim 15, wherein said step for controlling said heating energy comprises varying a level of a voltage supplied to said thermal print head and also varying a duration of a strobe signal applied to said thermal print head.

20. A printing method according to claim 15, wherein the step of sensing said medium comprises sensing the light transmissivity or reflectivity of said medium.

21. A printing method according to claim 15, wherein the step of sensing said printing film comprises sensing a bar-code on said printing film cartridge.

22. A printing method according to claim 15, wherein the printing film sensing step comprises sensing a shape of said cartridge; said cartridge having a shape corresponding to one of said at least two kinds of printing film contained therein.

* * * * *